US005697698A

United States Patent [19]

Huang

[11] Patent Number: 5,697,698

[45] Date of Patent: Dec. 16, 1997

[54] CHRISTMAS LAMP SOCKET

[76] Inventor: Shun-Feng Huang, No. 13, Lane 84, Nei Hu Road, Hsin-Chu City, Taiwan

[21] Appl. No.: 751,753

[22] Filed: Nov. 18, 1996

[51] Int. Cl.[6] ..... H01R 33/00

[52] U.S. Cl. ..... 362/226; 362/249; 362/391; 362/806

[58] Field of Search ..... 362/227, 249, 362/252, 806, 800, 226, 391

[56] References Cited

U.S. PATENT DOCUMENTS 4,802,072 1/1989 Kau ..... 362/806

5,367,443 11/1994 Hara ..... 362/227

5,526,246 6/1996 Liou ..... 362/806

*Primary Examiner*—Carroll B. Dority

*Attorney, Agent, or Firm*—Morton J. Rosenberg; David I. Klein

[57] ABSTRACT

A Christmas lamp socket has a housing and a lamp socket fitted in the housing. The housing has two opposite vertical ridges on an outer wall of an upper tubular portion to engage with two opposite vertical slots an annular wall of the lamp socket to keep secured tightly the whole lamp socket after the housing and the lamp socket are combined together. The housing further has two opposite vertical tubular members formed on its outer wall for locking two power leads therein with proper tightness.

1 Claim, 6 Drawing Sheets

CHRISTMAS LAMP SOCKET

BACKGROUND OF THE INVENTION

This invention concerns a Christmas lamp socket, particularly having a housing and a lamp socket fitted in the housing with proper tightness and able to prevent rain from flowing into the lamp socket, and the housing having two opposite vertical tubular members on its outer wall for locking power leads.

A known conventional Christmas lam socket shown in FIGS. 5 and 6 included a cylindrical housing 10 and a lamp socket 20 fitted in the base 10. The lamp socket 20 has two opposite flat plates formed on an outer intermediate wall and two opposite metal plates 202, 202 fitted between upper portions on the two flat plates. Power leads 203, 203 are connected with the lower ends of the two metal plates 202, 202, and a lamp is inserted in the lamp socket 20.

This structure of a Christmas lamp socket can be combined securely, but it can be short-circuited in case of rain falling and of a Christmas lamp network located outdoors, as rain may easily flow into the lamp socket 20 to cause short-circuit between the two metal plates 202, 202. In addition, the base 10 has no hooks or locking members for holding power leads securely, allowing the power leads 203, 203 entangled or twisting with one another, when a Christmas lamp network is organized.

SUMMARY OF THE INVENTION

This invention has been devised to offer a Christmas lamp socket having a structure for a housing and a lamp socket fitted in the base with proper tightness, and locking means for holding power leads with proper tightness to prevent them from entangling or twisting with one another in case they are used to organize a Christmas lamp network.

BRIEF DESCRIPTION OF DRAWINGS

This invention will be better understood by referring to the accompanying drawings, wherein.

DESCRIPTION OF THE PREFERRED EMBODIMENT

Figure 1:
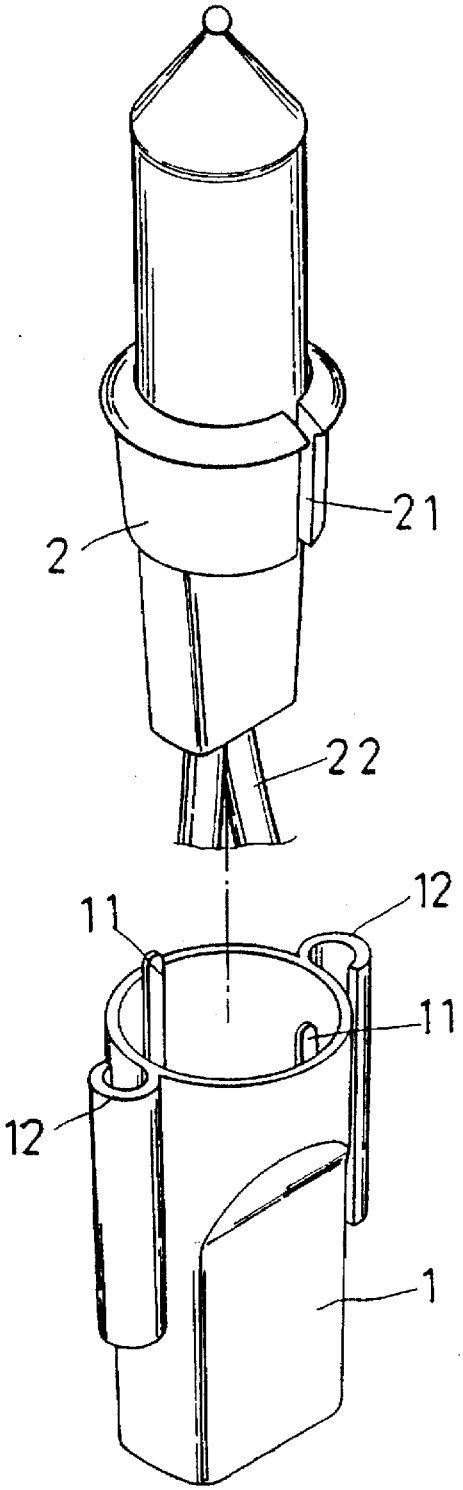
FIG. 1 is an exploded perspective view of a Christmas lamp socket in the present invention.
Figure 2:
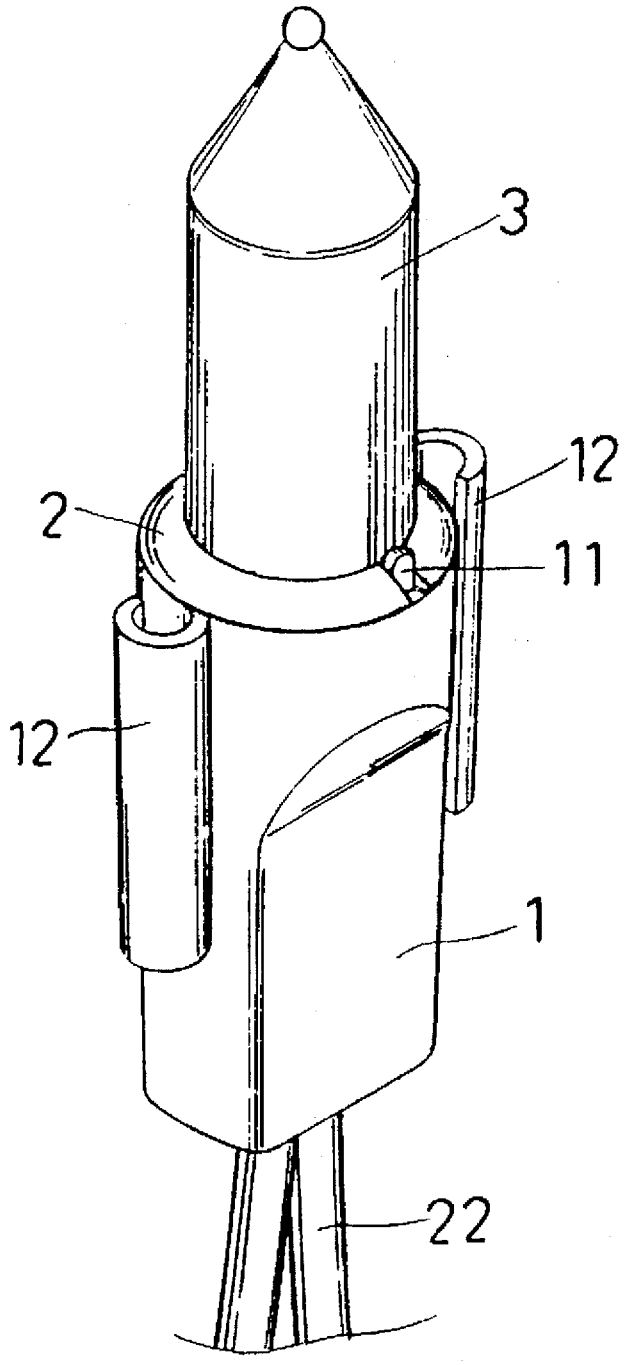
FIG. 2 is a perspective view of the Christmas lamp socket in the present invention.

A preferred embodiment of a Christmas lamp socket in the present invention, as shown in FIGS. 1 and 2, includes a housing 1 and an lamp socket 2 combined together.

The housing 1 has an upper tubular portion provided with two opposite vertical ridges 11, 11 on an inner wall. The housing 1 further has two opposite locking tubular members 12, 12 provided vertical on an outer peripheral wall of the upper tubular portion.

The lamp socket 2 is to receive a lamp therein, having two opposite vertical slots 21, 21 in an upper annular wall for the two opposite ridges 11, 11 of the housing 1 to engage therein when the housing 1 is combined with the lamp socket 2. Then the lamp socket 2 and the housing 1 can be kept secured with proper tightness in a combined condition.

Figure 3:
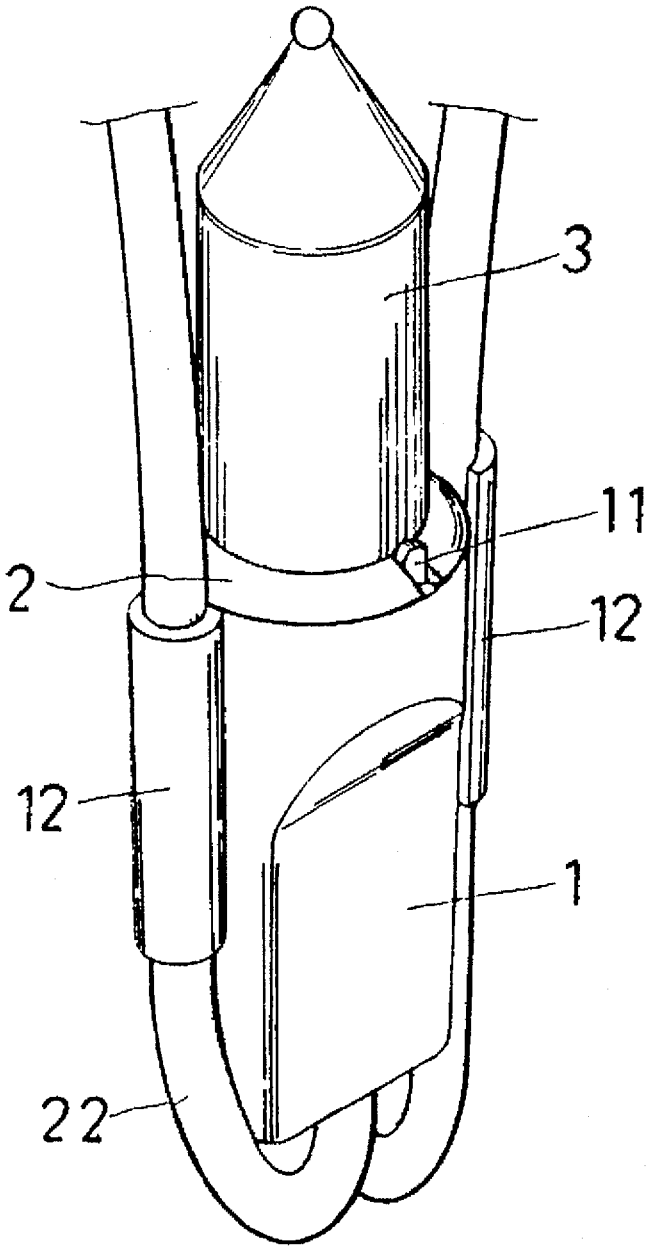
FIG. 3 is a perspective view of a locking tube of the Christmas lamp socket locking power leads in the present invention.
Figure 4:
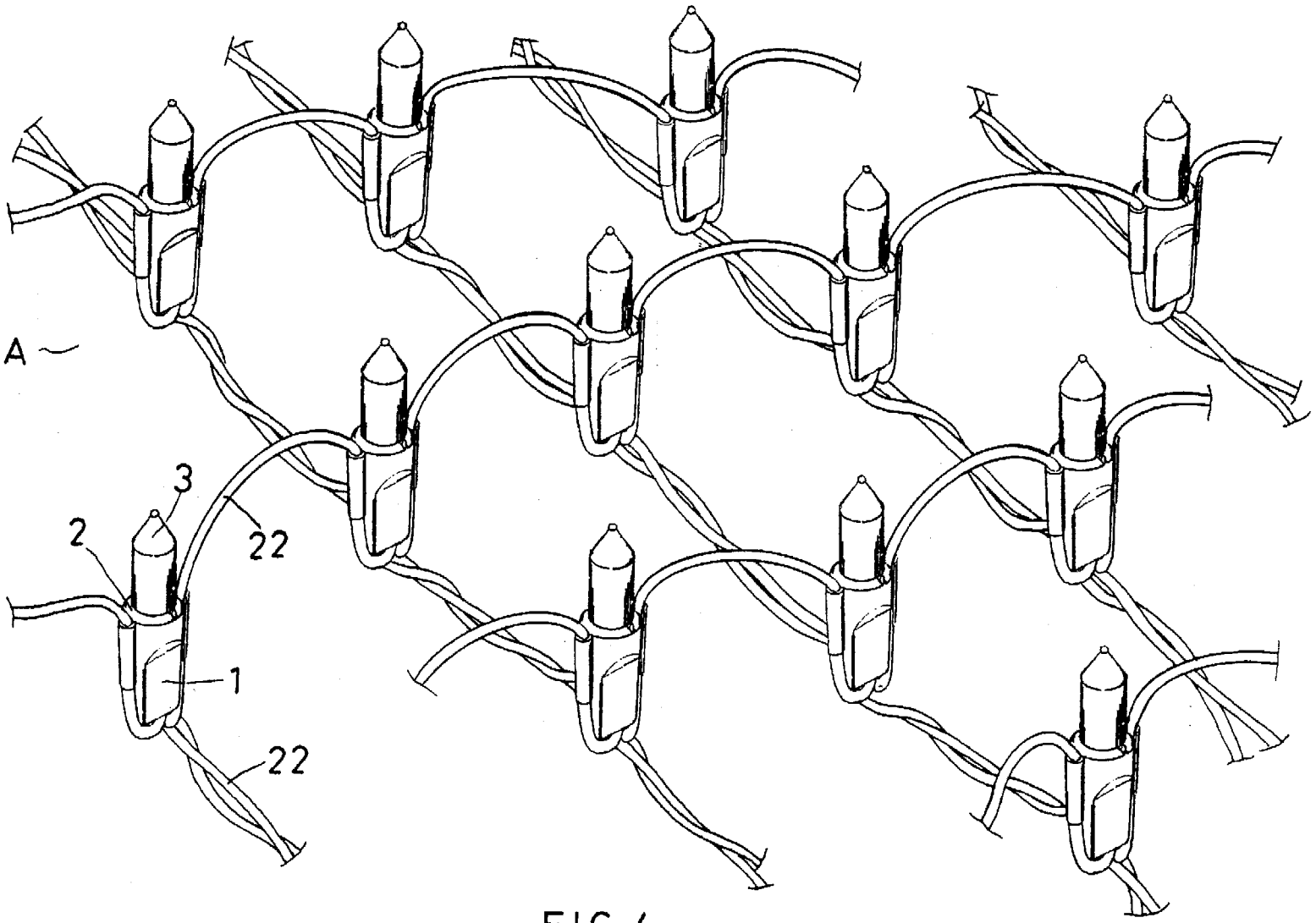
FIG. 4 is a perspective view of a plurality of the Christmas lamp sockets connected together in the present invention.
Figure 5:
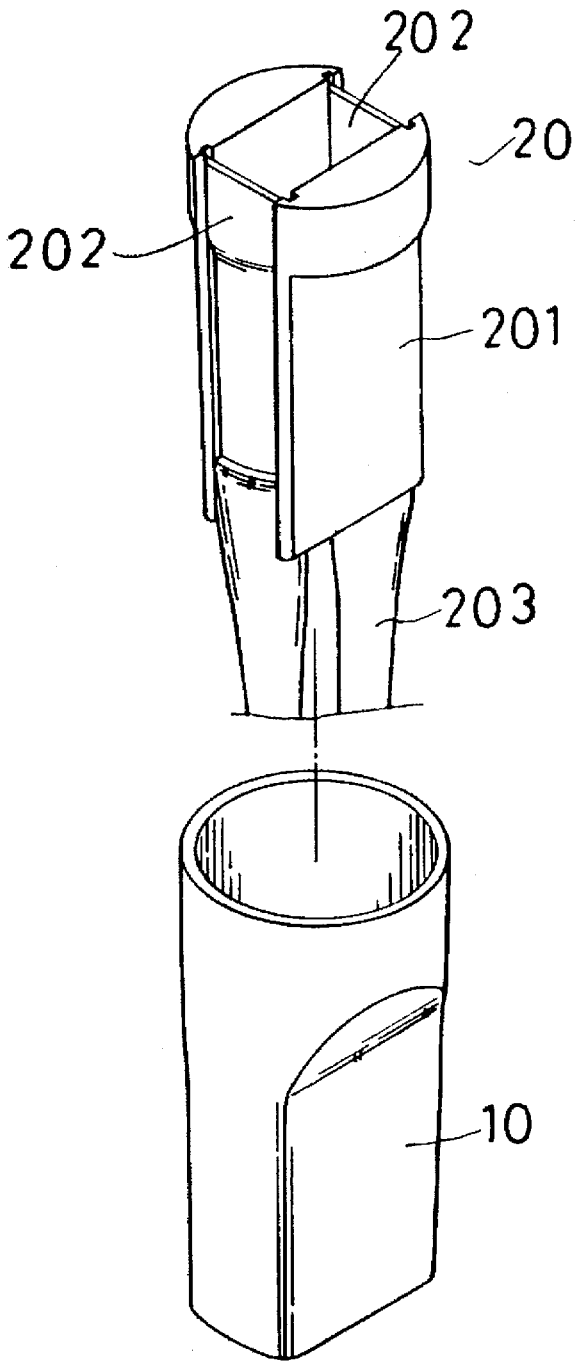
FIG.5 (PRIOR ART)
FIG. 5 is an exploded perspective view of a known conventional Christmas lamp socket.
Figure 6:
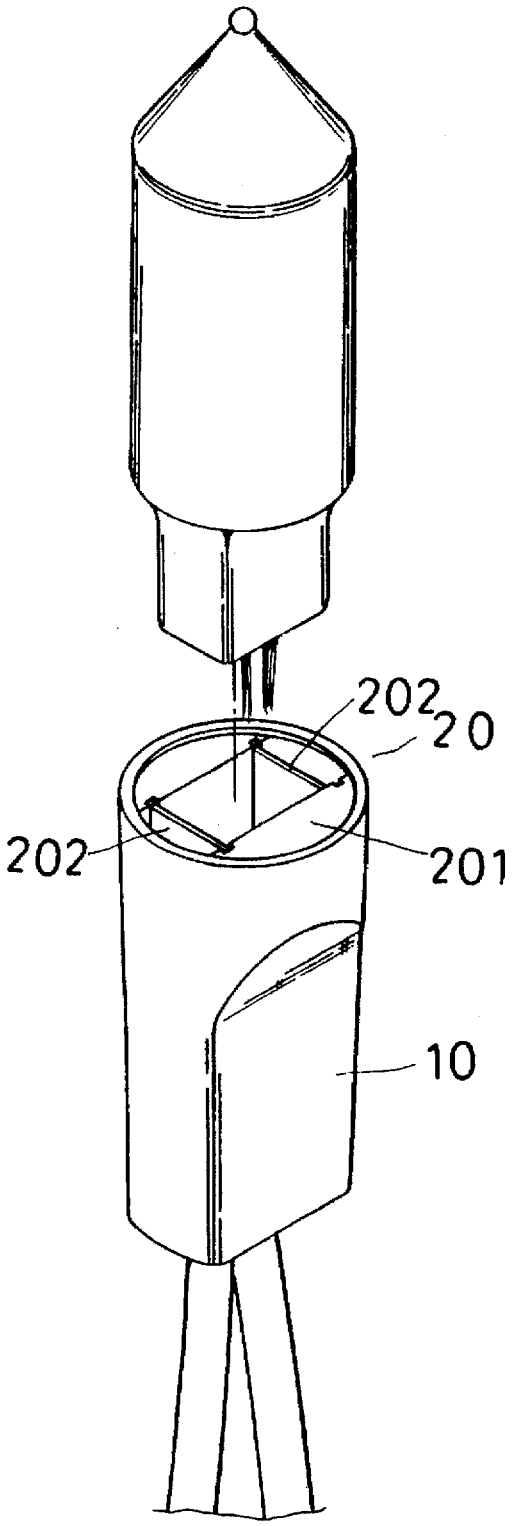
FIG. 6 (PRIOR ART)
FIG. 6 is a perspective view of the known conventional Christmas lamp socket in FIG. 5.

The two opposite locking tubular members 12, 12 of the housing 1 for pinching tightly two power leads 22, 22 therein after the housing 1 is combined with the lamp socket 2, as shown in FIG. 3. This structure of holding the power leads 22, 22 can be very useful to organize a Christmas lamp network shown in FIG. 4, preventing the power leads from entangled or twisting with one another and at the same time preventing rain from flowing into the lamp sockets 2 to avoid short-circuit in case the Christmas lamp network is located outdoors.

While the preferred embodiment of the invention has been described above, it will be recognized and understood that various modifications may be made therein and the appended claims are intended to cover all such modifications which may fall within the spirit and scope of the invention.

What is claimed is:

1. A Christmas lamp socket comprising a housing and a lamp socket fitted in said housing, said housing having an upper tubular portion and two opposite vertical ridges formed on an inner wall of said upper tubular portion, said lamp socket having two opposite slots in its outer annular wall, said two slots engaging with said two ridges of said housing when said housing is combined with said lamp socket so that said housing and the lamp socket may be kept with proper tightness in the combined combined condition, said housing further having two opposite tubular member formed on the outer peripheral wall of said upper tubular portion for locking two power leads therein with proper tightness.

* * * * *